US006720121B2

(12) United States Patent
Nakamura et al.

(10) Patent No.: US 6,720,121 B2
(45) Date of Patent: Apr. 13, 2004

(54) ELECTROPHOTOGRAPHIC PHOTOCONDUCTOR AND MANUFACTURING METHOD THEREFOR

(75) Inventors: Yoichi Nakamura, Nagano (JP); Koichi Aizawa, Nagano (JP); Teruo Sasaki, Nagano (JP); Kenichi Hara, Nagano (JP)

(73) Assignee: Fuji Electric Imaging Device Co. Ltd., Nagano (JP)

( * ) Notice: Subject to any disclaimer, the term of this patent is extended or adjusted under 35 U.S.C. 154(b) by 0 days.

(21) Appl. No.: 10/114,312

(22) Filed: Apr. 3, 2002

(65) Prior Publication Data

US 2002/0172878 A1 Nov. 21, 2002

(30) Foreign Application Priority Data

Apr. 4, 2001 (JP) ..... 2001-105892

(51) Int. Cl.[7] ..... G03G 5/047; G03G 5/04

(52) U.S. Cl. ..... 430/58.35; 430/56; 430/59.1; 430/70; 430/133; 430/134; 430/970; 430/58.05

(58) Field of Search ..... 430/59.1, 56, 70, 430/58.35, 133, 134, 970, 58.05

(56) References Cited

U.S. PATENT DOCUMENTS

| | | | | |
|---|---|---|---|---|
| 3,463,838 A | | 8/1969 | Hensel et al. | |
| 5,759,727 A | | 6/1998 | Malhotra | |
| 5,945,243 A | * | 8/1999 | Nakamura et al. | 430/56 |
| 6,200,714 B1 | * | 3/2001 | Nakamura et al. | 430/56 |

FOREIGN PATENT DOCUMENTS

| | | |
|---|---|---|
| JP | 53-59429 | 5/1978 |
| JP | 08-297373 | 11/1996 |
| JP | 08-314240 | 11/1996 |

OTHER PUBLICATIONS

Da Silva, J.F. Cajaiba, "One–Pot" Synthesis of Triaryl Phosphates A Reaction Calorimetry Approach. *Phosphorous, Sulfur, and Silicon,* 1997, vol. 131, pp. 71–82.

* cited by examiner

*Primary Examiner*—Christopher Rodee

(57) ABSTRACT

An electrophotographic photoconductor and method of manufacturing thereof exhibits excellent characteristics of residual potential and repetition potential by containment of an additive of a compound. The electrophotographic photoconductor includes a conductive substrate and a photosensitive layer on the substrate, in which the photosensitive layer contains tri(4-nitrophenyl) phosphate.

9 Claims, 1 Drawing Sheet

ELECTROPHOTOGRAPHIC PHOTOCONDUCTOR AND MANUFACTURING METHOD THEREFOR

CROSS-REFERENCED TO RELATED APPLICATIONS

This application claims the benefit of Japanese application no. 2001-105892, filed Apr. 4, 2001, the disclosure of which is incorporated herein by reference.

BACKGROUND OF THE INVENTION

1. Field of the Invention

The present invention relates to a photoconductor used in electrophotographic apparatuses, in particular, to an electrophotographic photoconductor and method of manufacturing thereof exhibiting excellent characteristics of residual potential and repetition potential by virtue of improved additives in a photosensitive layer and coating liquid to form the photosensitive layer.

2. Description of the Related Art

A photoconductor is required to have functions of maintaining surface charges in the dark, generating charges upon receipt of light, and transporting the generated charges upon receipt of the light. Conventional photoconductors include a so-called single-layer type photoconductor having the functions in a single photosensitive layer, and a so-called laminated-layer type photoconductor having function-separated two layers: a first layer that mainly serves to generate charges upon receipt of light and a second layer that serves to maintain surface charges in the dark and transport the generated charges upon receipt of the light.

To form images by an electrophotographic method using the above types of photoconductors, a Carlson process, for example, is applied. The image formation by this process may be performed by charging the photoconductor in the dark by a corona discharge, forming an electrostatic latent image, representing characters or drawings of an original on the charged surface of the photoconductor, developing the thus formed electrostatic latent images by means of toner particles, and transferring and fixing of the developed toner image onto a support, such as paper. After the toner image is transferred, remaining toner particles are eliminated and residual electrostatic charges are removed by erase exposure, so that the photoconductor can be used again.

As photosensitive materials of the photoconductors, there have been used inorganic photoconductive substances, such as selenium, selenium alloys, zinc oxide, and cadmium sulfide dispersed in a resin binder. Besides, organic photoconductive substances, such as poly-N-vinylcarbazole, 9,10-anthracenediole polyester, hydrazone, stylbene, butadiene, benzidine, phthalocyanine and bisazo compound have been also used by dissolving and dispersing in a resin binder, or by deposition in a vacuum or sublimation.

In order to improve performances and prevent defects of the photoconductors, studies have been made on photosensitive materials and improved techniques have been proposed on photoconductors and their manufacturing methods. Improvement of photoconductor performances is widely intended by including some additives in the photosensitive layer of a photoconductor.

It is known in a field of electrophotographic technology to use a phosphate compound as such an additive. Japanese Unexamined Patent Application Publication S53-59429, Japanese Unexamined Patent Application Publication H8-314240, and U.S. Pat. No. 5,759,727 disclose a use of a triphenyl phosphate as a plasticizer to obtain flexibility or a material to attain transparency. Japanese Unexamined Patent Application Publication H8-297373 discloses a use of triphenyl phosphate in order to obtain an electrophotographic photoconductor that hardly accumulates residual potential in repeated operations under a high temperature and humidity environment and exhibits excellent durability.

Although numerous studies have been made on electrophotographic photoconductors and their manufacturing methods as described above, fully satisfactory performance has not been attained yet. In particular, the characteristics of residual potential and repetition potential need further improvement.

SUMMARY OF THE INVENTION

To solve the above problems, an objective of the present invention is to provide an electrophotographic photoconductor that exhibits excellent characteristics of residual potential and repetition potential by using a compound as an additive that has never been used in a photoconductor. It is another object of the invention to provide a method for manufacturing such a photoconductor.

The inventors of the present invention have made intense studies to solve the above problem and found that both residual potential and repetition potential substantially decrease when tri(4-nitrophenyl) phosphate is contained as an additive in a photosensitive layer of the photoconductor. The invention has been accomplished based on the aforementioned finding. Although conventional techniques to use a phosphate compound, such as triphenyl phosphate as an additive have been known, the conventional techniques do not include using tri(4-nitrophenyl) phosphate at all, which indicates that an effect of the tri(4-nitrophenyl) phosphate on photoconductor characteristics is unclear. The inventors gave attention to the tri(4-nitrophenyl) phosphate and clarified a relationship between the phosphate compound and photoconductor characteristics. Thus, a photoconductor having satisfactory performance has been obtained and a manufacturing method for such photoconductor has been established.

A photoconductor of the present invention includes a conductive substrate and a photosensitive layer on the substrate, the photosensitive layer including tri(4-nitrophenyl) phosphate. A method of the present invention to manufacture a photoconductor includes forming a photosensitive layer by coating a conductive substrate with coating liquid including photosensitive material and tri(4-nitrophenyl) phosphate.

These together with other objects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The above objective and advantage of the present invention will become more apparent by describing in detail preferred embodiments thereof with reference to the attached drawings in which.

DESCRIPTION OF THE PREFERRED EMBODIMENTS

Figure 1A:
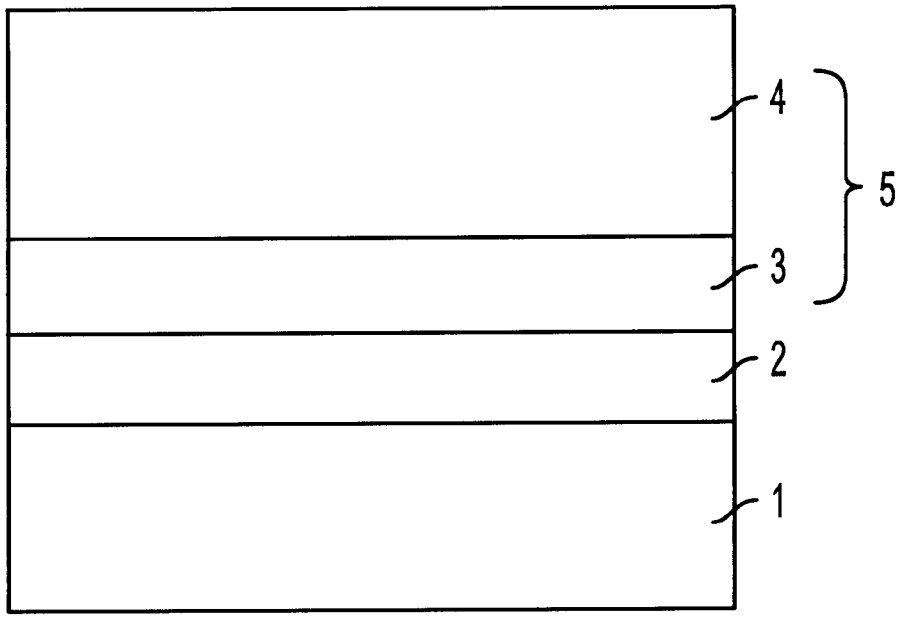
FIG. 1A is a schematic diagram illustrating a negative-charging laminated-layer type photoconductor.
Figure 1B:
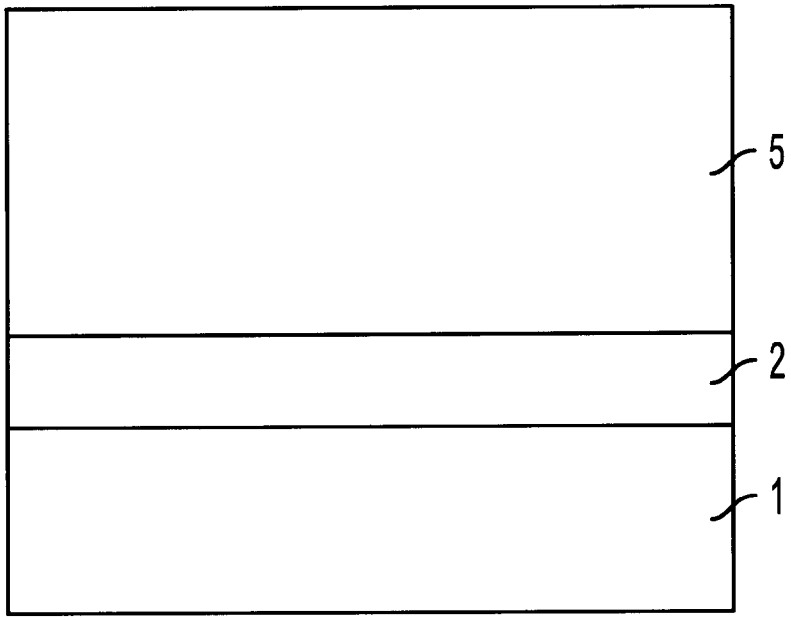
FIG. 1B is a schematic diagram illustrating a positive-charging single-layer type photoconductor.

Specific constructions of photoconductors according to an exemplary embodiment of the present invention will be described with reference to the accompanying drawings. As described earlier, photoconductors are classified into (a) laminated-layer type or function-separated type photoconductors including a negative-charging laminated-layer type photoconductor and a positive-charging laminated-layer type photoconductor, and (b) single-layer type photoconductors, which are mostly positive-charging type. FIG. 1A and FIG. 1B are schematic cross-sectional views of typical structures of these photoconductors, wherein FIG. 1A shows a negative-charging laminated-layer type photoconductor and FIG. 1B shows a positive-charging single-layer type photoconductor.

The negative-charging laminated-layer type photoconductor as shown in FIG. 1A includes a conductive substrate 1 and an undercoat layer 2 and a photosensitive layer 5, which includes a charge generation layer 3 performing a charge generating function and a charge transport layer 4 performing a charge transporting function, sequentially laminated on the substrate 1. The positive-charging single-layer type photoconductor as shown in FIG. 1B includes the conductive substrate 1, and the undercoat layer 2 and a single photosensitive layer 5 performing both the charge generating and charge transporting functions. In the both types of photoconductors, the undercoat layer may be provided if necessary, and a surface protective layer may further be provided on the photosensitive layer 5 though not shown in the figures.

The photoconductor according to an exemplary embodiment of the present invention will be described in detail with respect to the negative-charging laminated-layer type photoconductor of FIG. 1A. Materials and methods to form or manufacture the photoconductor may be appropriately selected from known materials and methods except for those relating to tri(4-nitrophenyl) phosphate.

The conductive substrate 1 functions as an electrode of the photoconductor and also functions as a support for the other layers constituting the photoconductor. The substrate 1 may have a cylindrical shape, a planer shape, or a film-like shape, and may be formed of a metal or an alloy such as aluminum, stainless steel or nickel, or glass or resin that has been treated to give a certain conductivity to the surface.

The undercoat layer 2 is provided for the purpose of controlling charge injection from the conductive substrate into the photosensitive layer, covering defects on the surface of the substrate, and improving adhesiveness of the photosensitive layer with the substrate. Materials used for the undercoat layer include alcohol-soluble polyamide, solvent-soluble aromatic polyamide, and thermosetting urethane resin. The alcohol-soluble polyamide may include, for instance, copolymers such as nylon 6, nylon 8, nylon 12, nylon 66, nylon 610, and nylon 612, and N-alkyl-modified or N-alkoxyalkyl-modified nylon. Some examples of specific product of this type of compound include AMILAN CM8000, a 6/66/610/12 copolymerized nylon manufactured by Toray Industries Co., Ltd., ELBAMIDE 9061, a 6/66/612 copolymerized nylon manufactured by Du Pont Japan Ltd., and DAIAMIDE T-170, a copolymerized nylon of mainly nylon 12 manufactured by Daicel-Huels Co., Ltd. The undercoat layer 2 may also contain fine powder of inorganic substance such as $TiO_2$, alumina, calcium carbonate, or silica.

The charge generation layer 3, which serves to generate charges upon receipt of light, is formed by depositing charge generating substance in a vacuum, or by coating with a coating liquid in which particles of charge generating material are dissolved and dispersed in a resin binder. The charge generation layer 3 is desired to generate charges with high efficiency and also to have favorable capability of injecting the generated charges into the charge transport layer 4. Namely, the charge injection is desired to be less dependent on electric field, and to be facilitated even under low electric field.

The charge generation material may be one of pigments and dyes, such as phthalocyanine, azo, quinone, indigo, cyanine, squarilium, or azulenium compounds. The resin binder used in the charge generation layer may be one of polycarbonate resin, polyester resin, polyamide resin, polyurethane resin, epoxy resin, poly(vinyl butyral) resin, phenoxy resin, silicone resin, methacrylate resin, vinyl chloride resin, ketal resin, vinyl acetate resin, and polymers and copolymers of these resins, which may be used in suitable combination.

A content of the charge generation material relative to a content of the resin binder in the charge generation layer is in the range of 10 to 5,000 parts by weight, preferably 50 to 1,000 parts by weight with respect to 100 parts by weight of the resin binder. The charge generation layer 3 contains charge generation material as a major component; to which charge transport material and others may be added. The film thickness of the charge generation layer is determined depending on a light absorption coefficient of the charge generating substance, and is generally controlled to be not more than 5 $\mu$m, preferably, not more than 1 $\mu$m.

The charge transport layer 4 is a coating film of a material composed of charge transport substance dissolved in a resin binder. The charge transport layer 4 has functions of maintaining surface charges in the dark as an insulator and transporting the injected charges from the charge generation layer upon receipt of light. A charge transport material for the charge transport layer 4 may be selected from a hydrazone compound, a styryl compound, an amine compound, and their derivatives, which may be used alone or in suitable combination. The resin binder used in the charge transport layer 4 may include polymers and copolymers of polycarbonate, polyester, polystyrene, or methacrylate. For the binder resin of the charge transport layer, compatibility with the charge transport substance is important as well as mechanical, chemical and electrical stability and adhesiveness.

The content of the charge transport material relative to the content of the resin binder in the charge transport layer 4 is in a range of 20 to 500 parts by weight, for instance, 30 to 300 parts by weight with respect to 100 parts by weight of the resin binder. The film thickness of the charge transport layer may be held in a range of 3 to 50 $\mu$m, for instance, 15 to 40 $\mu$m, so as to maintain practically effective surface charges.

The photosensitive layer 5 may be either of single-layer type or laminated-layer type, and shall not be limited to any one of the two types. When the photosensitive layer is of a laminated-layer type consisting of a charge generation layer and a charge transport layer, in particular, tri(4-nitrophenyl) phosphate is contained in the charge transport layer 4. The tri(4-nitrophenyl) phosphate can be synthesized according to methods disclosed in the following references, for examples,—Jack Hensel et at., U.S. Pat. No. 3,463,838, and—J. F. Cajaiba Da Silva, et al., Phosphorus, Sulfur Silicon Relat. Elem. 131, 71 (1997).

A content of the tri(4-nitrophenyl) phosphate may appropriately be adjusted according to a demanded electrophotographic characteristic. In a laminated-layer type photoconductor, for example, the content may be in the range from 0.001 to 10 weight percent, for instance, 0.01 to 5 weight percent with respect to the total weight of the charge transport layer.

The mechanism is not fully understood how to substantially lower the residual potential and to significantly suppress growing-up of repetition potential. However, the following reason may be supposed. Because tri(4-nitrophenyl) phosphate captures the electric charges in the photosensitive layer, accumulation of the charges in the photosensitive layer is inhibited. Therefore, both residual potential and potential variation in the repeated use can significantly be reduced.

A method of the present invention of manufacturing the electrophotographic photoconductor includes forming a photosensitive layer 5 by coating a conductive substrate 1, through an undercoat layer if necessary, with a coating liquid including electrophotographic photosensitive material, where the coating liquid contains tri(4-nitrophenyl) phosphate. Other steps and manufacturing conditions are not accompanied by any special limitations. The electrophotographic photosensitive material may one of the above-described charge generation materials, the charge transport materials, and the resin binders, which are used to prepare the coating liquid with tri(4-nitrophenyl) phosphate contained therein and to form the photosensitive layer 5, particularly, a charge transport layer 4 in a case of a laminated-layer type photoconductor.

The coating liquid in a manufacturing method of the present invention may be applied to any coating method including dip-coating and spray-coating, and is not limited to any specific coating method.

EXAMPLES

The invention will be described in further detail referring to examples of embodiments thereof. However, the invention shall not be limited to the referred examples.

EXAMPLE 1

The coating liquid for the undercoat layer 2 is prepared by mixing 70 parts by weight of polyamide resin: AMILAN CM8000 manufactured by Toray Industries Co., Ltd. and 930 parts by weight of methanol. The undercoat layer 2 having thickness of 0.5 $\mu$m is formed by coating the substrate of aluminum with the coating liquid using the dip-coating method and drying.

The coating liquid for the charge generation layer was prepared by mixing and ultrasonically dispersing 20 parts by weight of titanyloxyphthalocyanine manufactured by Fuji Electric Co., Ltd., 676 parts by weight of dichloromethane, 294 parts by weight of 1,2-dichloroethane, and 10 parts by weight of poly(vinyl chloride) resin: MR-110 manufactured by Nippon Zeon Co., Ltd. Coating the undercoat layer 2 with the coating liquid by dip-coating method and drying forms the charge generation layer 3 having a thickness of 0.2 $\mu$m.

The coating liquid for the charge transport layer 4 is prepared by mixing 100 parts by weight of a charge transport substance represented by a formula (1) manufactured by Fuji Electric Co., Ltd., 100 parts by weight of a polycarbonate resin: PANLITE K-1300 manufactured by Teijin Chemicals, Ltd., 1 part by weight of tocopherol manufactured by Wako Pure Chemical Industries Co., Ltd., 1 part by weight of 2,4-di-tert-butylphenoxy diphenylphosphine manufactured by Fuji Electric Co., Ltd., 2 parts by weight of tri(4-nitrophenyl) phosphate manufactured by Fuji Electric Co., Ltd., 1 part by weight of silane coupling agent: KP-340 manufactured by Shin'etsu Chemical Industries Co., Ltd., and 800 parts by weight of dichloromethane. The charge transport layer 4 having thickness of 20 $\mu$m is formed by coating the charge generation layer 4 with the coating liquid by dip-coating method and drying. Thus, an electrophotographic photoconductor is produced.

(1)

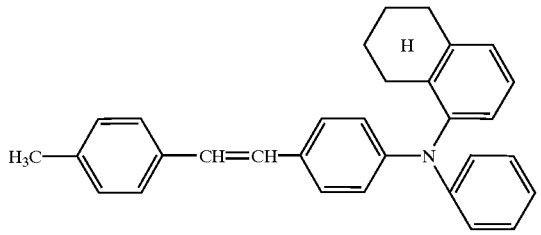

EXAMPLE 2

The photoconductor is produced in a same manner as in Example 1 except that the charge transport substance represented by the formula (1) is replaced by the charge transport substance represented by formula (2) manufactured by Fuji Electric Co., Ltd.

(2)

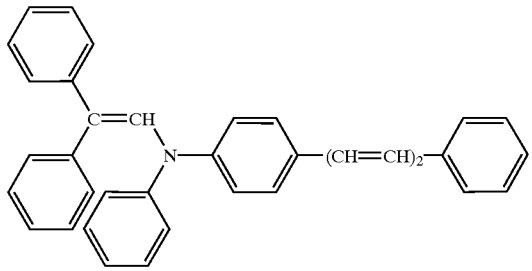

COMPARATIVE EXAMPLE 1

The photoconductor is produced in the same manner as in Example 1 except that the tri(4-nitrophenyl) phosphate is not used.

COMPARATIVE EXAMPLE 2

The photoconductor is produced in the same manner as in Example 1 except that the tri(4-nitrophenyl) phosphate is replaced by triphenyl phosphate manufactured by Wako Pure Chemical Industries Co., Ltd.

COMPARATIVE EXAMPLE 3

The photoconductor is produced in the same manner as in Example 2 except that the tri(4-nitrophenyl) phosphate is not used.

COMPARATIVE EXAMPLE 4

The photoconductor is produced in a same manner as in Example 2 except that the tri(4-nitrophenyl) phosphate is replaced by triphenyl phosphate manufactured by Wako Pure Chemical Industries Co., Ltd.

Residual potential and repetition potential of the, thus, obtained Examples 1 and 2 and Comparative Examples 1 through 4 are measured with a static recording paper test apparatus EPA-8200 manufactured by Kawaguchi Electric Works Co., Ltd. Initially, the photoconductor surface is charged to a negative potential by a corona discharge at −5 kV for 10 seconds in the dark. Subsequently, a surface potential after irradiation of a laser light of 5 $\mu J/cm^2$ at a wavelength of 780 nm is measured to obtain a residual potential. After repeating this process to measure residual potential 1,000 times, the surface potential is measured to obtain a repetition potential. The results are shown in Table 1.

TABLE 1

| | residual potential (V) | repetition potential (V) |
|---|---|---|
| Example 1 | −9 | −14 |
| Example 2 | −11 | −17 |
| Comparative Example 1 | −24 | −59 |
| Comparative Example 2 | −27 | −53 |
| Comparative Example 3 | −28 | −71 |
| Comparative Example 4 | −33 | −69 |

As apparent from Table 1, every photoconductor of Examples 1 and 2, which contains tri(4-nitrophenyl) phosphate in the photosensitive layer, exhibits low residual potential and insignificant rise of repetition potential, which is a favorable performance. In contrast, every photoconductor of Comparative Examples 1 through 4 exhibits quite high values of the residual and repetition potentials.

As described so far, the photoconductor according to the present invention, which includes a photosensitive layer on a conductive substrate, the photosensitive layer including tri(4-nitrophenyl) phosphate, exhibits excellent characteristics of residual potential and repetition potential.

A method according to the present invention of manufacturing the photoconductor, includes forming the photosensitive layer by coating the conductive substrate with the coating liquid that contains tri(4-nitrophenyl) phosphate. The method to manufacture the photoconductor has excellent characteristics of residual potential and repetition potential.

While this invention has been particularly shown and described with reference to preferred embodiments thereof, it will be understood by those skilled in the art that various changes in form and details may be made thereto without departing from the spirit and scope of the invention as defined by the appended claims.

What is claimed:

1. An electrophotographic photoconductor, comprising:

a conductive substrate; and a photosensitive layer on the conductive substrate, the photosensitive layer comprising tri(4-nitrophenyl) phosphate.

2. A method of manufacturing an electrophotographic photoconductor, comprising:

forming a photosensitive layer by coating a conductive substrate with a coating liquid comprising photosensitive material and tri(4-nitrophenyl) phosphate.

3. A negative-charging laminated-layer type photoconductor, comprising:

a conductive substrate; and a photosensitive layer comprising a charge generation layer and a charge transport layer sequentially laminated on the substrate, wherein the conductive substrate supports the photosensitive layer in the photoconductor, the charge generation layer performs a charge generating function, and the charge transport layer comprising tri(4-nitrophenyl) phosphate performs a charge transporting function.

4. The photoconductor as recited in claim 3, further comprising:

an undercoat layer controlling a charge injection from the conductive substrate into the photosensitive layer, covering defects on a surface of the substrate, and adhering the photosensitive layer to the substrate.

5. The photoconductor as recited in claim 3, wherein the conductive substrate comprises a cylindrical shape, a planer shape, or a film-like shape, and is formed of a metal or an alloy comprising aluminum, stainless steel or nickel, or glass or resin.

6. A positive-charging single-layer type photoconductor, comprising:

a conductive substrate; and a single photosensitive layer comprising tri(4-nitrophenyl) phosphate and performing charge generating and charge transporting functions, wherein the conductive substrate supports the layers in the photoconductor.

7. The photoconductor as recited in claim 6, further comprising:

an undercoat layer controlling a charge injection from the conductive substrate into the photosensitive layer, covering defects on a surface of the substrate, and adhering the photosensitive layer to the substrate.

8. The photoconductor as recited in claim 6, wherein the conductive substrate comprises a cylindrical shape, a planar shape, or a film-like shape, and is formed of a metal or an alloy comprising aluminum, stainless steel or nickel, or glass or resin.

9. A method of manufacturing an electrophotographic photoconductor comprising a photosensitive layer, an undercoat layer, and a conductive substrate, the method comprising:

forming the undercoat layer by coating the conductive substrate with a coating liquid, and coating the undercoat layer with a coating liquid comprising electrophotographic photosensitive material and tri(4-nitrophenyl) phosphate to form the photosensitive layer, wherein the electrophotographic photosensitive material comprises one of a charge generation material, a charge transport material, and resin binders.

* * * * *